US007797858B2

(12) United States Patent
Gallay

(10) Patent No.: US 7,797,858 B2
(45) Date of Patent: Sep. 21, 2010

(54) SNOWSHOES WITH BINDING AND CROSS-PIECE

(75) Inventor: Philippe Gallay, La Clusaz (FR)

(73) Assignee: TSL Sport Equipment, Alex (FR)

( * ) Notice: Subject to any disclaimer, the term of this patent is extended or adjusted under 35 U.S.C. 154(b) by 823 days.

(21) Appl. No.: 11/657,371

(22) Filed: Jan. 24, 2007

(65) Prior Publication Data

US 2007/0180735 A1 Aug. 9, 2007

(30) Foreign Application Priority Data

Jan. 25, 2006 (FR) ..... 06 00895

(51) Int. Cl.
*A43B 5/04* (2006.01)

(52) U.S. Cl. ..... 36/125

(58) Field of Classification Search ..... 36/122–125
See application file for complete search history.

(56) References Cited

U.S. PATENT DOCUMENTS

| | | | | |
|---|---|---|---|---|
| 5,259,128 | A | 11/1993 | Howell | 36/122 |
| 5,540,002 | A | 7/1996 | Liautaud | 36/122 |
| 5,659,981 | A | 8/1997 | Liautaud | 36/122 |
| 7,493,709 | B2 * | 2/2009 | Trask et al. | 36/122 |
| 2004/0083626 | A1 | 5/2004 | Trask et al. | 36/122 |

FOREIGN PATENT DOCUMENTS

| | | |
|---|---|---|
| FR | 2818156 | 6/2002 |

* cited by examiner

*Primary Examiner*—Ted Kavanaugh
(74) *Attorney, Agent, or Firm*—Fay Sharpe LLP

(57) ABSTRACT

A snowshoe (1) whose binding (5) for retaining of the boot is mounted on a cross-piece (9) whose ends are mounted laterally to the snowshoe itself, characterized in that the aforementioned ends are mounted via two couplings (7*a*, 7*b*) of two rings, namely a left coupling (7*a*) and a right coupling (7*b*).

12 Claims, 5 Drawing Sheets

SNOWSHOES WITH BINDING AND CROSS-PIECE

BACKGROUND

The present invention relates to a snowshoe and more particularly an improvement for a snowshoe of the type whose binding for retaining of the boot is removably mounted on a cross-piece whose ends are connected to a framework.

The snowshoes, devices known for very many years, have been used for several centuries by the Scandinavian populations to move on snow. Until recently, snowshoes were used by ordinary travelers or soldiers to allow the populations and the alpine troops to move on snow for their movements required by the everyday life. Currently, snowshoes are instead used by walkers or sportsmen who undertake excursions and walks, and even competitions. But the sportsmen, although participating for their pleasure, are increasingly demanding for the equipment which they use, and it is true that the currently sold products do not give whole satisfaction.

Many types of snowshoes are known and in particular the snowshoes of the type which one finds in Europe, made up by a webbing made out of plastic on which the boot is retained by a hinged plate.

Also know are snowshoes originating in North America which generally include a tubular framework supporting a tensioned fabric which constitutes the webbing. These snowshoes have many advantages and are generally relatively well adapted to the snow conditions which one finds in this area. However it appears that these snowshoes present disadvantages. For these snowshoes the binding for the boot is accomplished by a binding which pivots around a transverse axis. To this end the binding is retained on a transverse cross-piece generally made out of a flexible material such as a textile or similar strap as out of plastic or out of leather, this strap gives a flexibility in advantageous lateral twisting, which provides the comfort for walking in particular by canting. The strap is either mounted to the framework such as that appears on the U.S. Pat. No. 3,555,708 or mounted on a freely pivoting ring such as that appears on the U.S. Pat. Nos. 5,659,981, 5,517,772, 5,259,128. As the strap is mounted directly on the framework when lifting of the heel of the user, the rear of the snowshoe is urged to pivot upward which causes an unquestionable discomfort and throws snow on the user. When the strap is freely pivoting, in a steep hill climb, the tibia can touch the front spatula of the snowshoe, which makes walking uncomfortable.

SUMMARY

The present invention proposes to solve the above mentioned disadvantages using simple, reliable and easy to implement means.

Thus, the snowshoe according to the invention is of the type of which the binding for retaining of the boot is releasably mounted to a cross-piece whose ends are mounted laterally to the snowshoe itself, and is characterized in that the aforementioned ends are mounted via two couplings of two rings, namely a left coupling (7*a*) and a right coupling (7*b*).

According to a complementary characteristic, each coupling includes a end ring mounted to the end of the cross-piece coupled with a corresponding retaining ring connected to the snowshoe, while each end ring passes thorough the hole defined in the corresponding retaining ring and of each retaining ring passes through the hole defined in the corresponding end ring.

According to another characteristic, each ring includes a rectilinear connecting branch and a curved mounting branch, the rectilinear connecting branch being that which is linked to the snowshoe for the retaining ring, and to the cross-piece for the end ring, while the branches of each ring are not in the same plane.

Let us add that the curved mounting branch in an end view defines a kind of "Z" for the rings of the right coupling and the form of a "S" for the rings of the left coupling, so that in the initial position, the curved branches of each coupling are reciprocal rearward stops, namely that the curved branches of the framework retaining rings define a rear stop for the curved branch of the end ring, so that at the time of lifting the heel of the boot there is free forward pivoting of the cross-piece around the transverse pivot axis while the curved branch of the framework retaining ring defines a forward stop for the curved branch of the end ring.

Also let us note that according to the embodiment given by way of example, the snowshoe includes a framework, and the retaining rings are connected to this framework by mounting straps.

BRIEF DESCRIPTION OF THE DRAWINGS

Other characteristics and advantages of the invention will emerge from the description which will follow compared to the annexed drawings which are given only by way of non-restrictive examples.

FIG. 1 is a top view of the snowshoe of the invention, intended to retain the boot (the binding being represented in phantom).

FIG. 2 is a side view.

FIG. 3 represents in prospective view or the snowshoe, without the binding intended to retain the boot.

FIG. 4 is a partial prospective view of the snowshoe in the position in which the heel of the boot is raised, the binding for the boot not being represented.

FIG. 5 is a top view depicting the left coupling.

FIG. 6 is a top view depicting the right coupling.

FIGS. 7 and 8 are diagrammatic views showing how the forward stop is implemented, for FIG. 7 of the left coupling, and for FIG. 8 of the right coupling.

DETAILED DESCRIPTION

Figure 1:
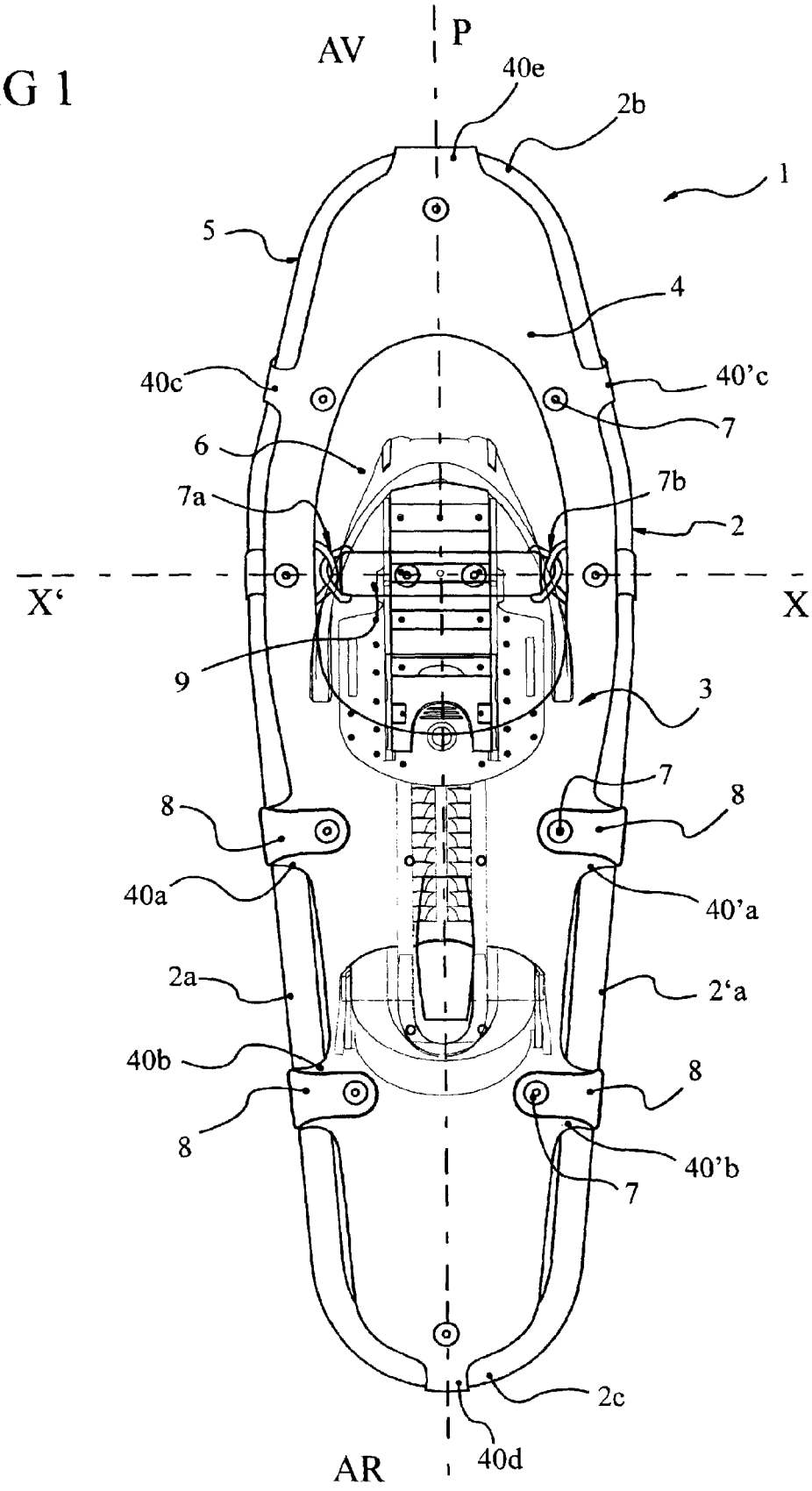
FIGS. 1 to 8 illustrate a preferred embodiment.
Figure 2:
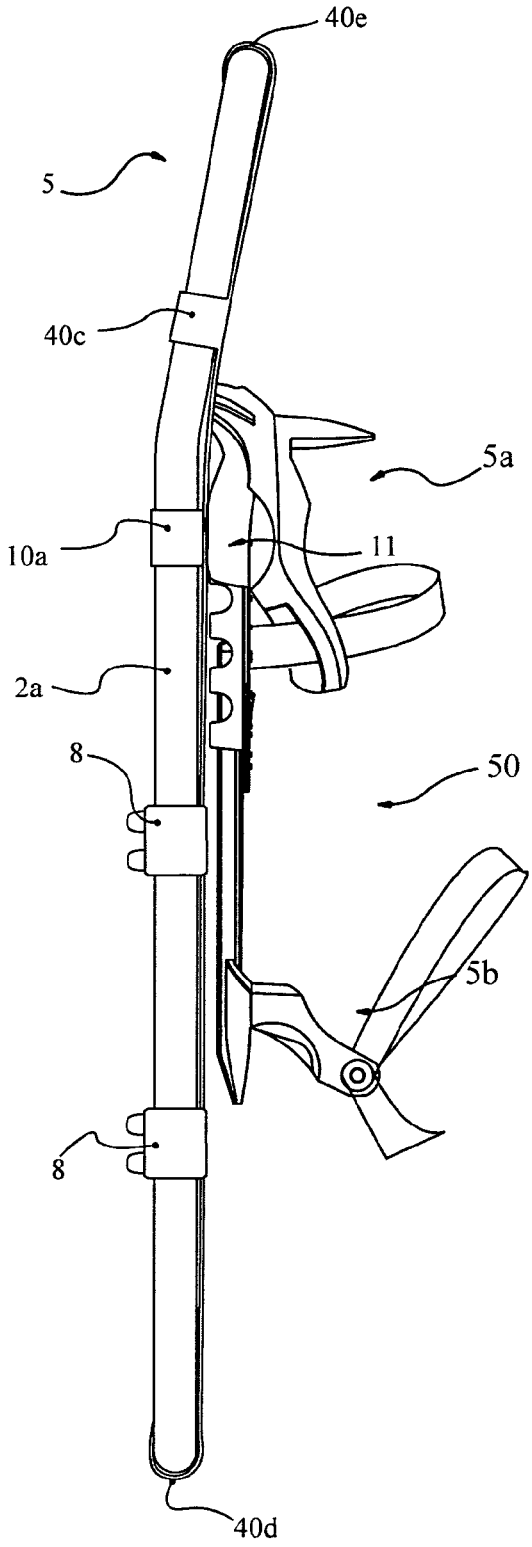
Figure 3:
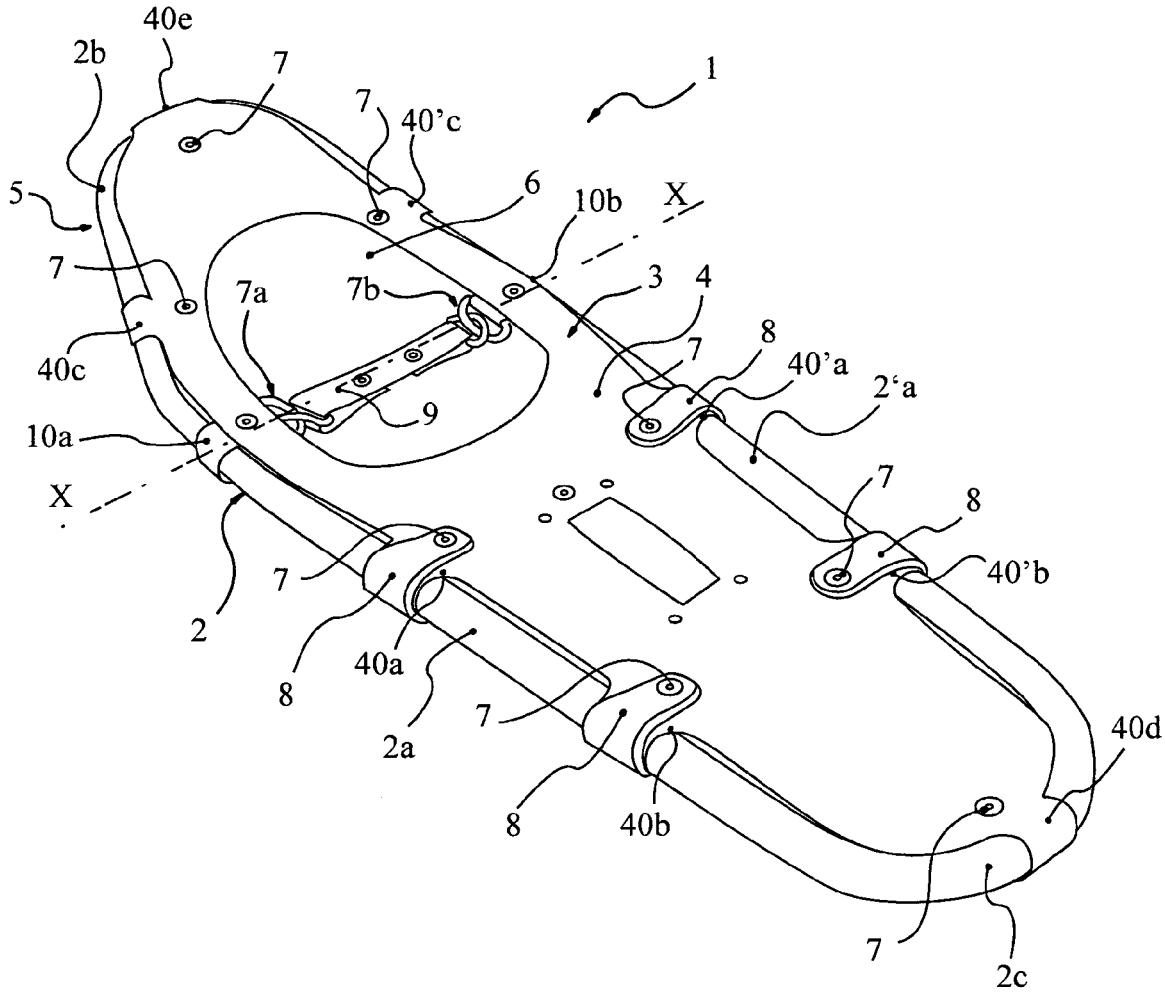

The snowshoe itself, carrying the general reference 1, includes a framework 2 delimiting a webbing intended to receive the boot of the user, the aforementioned boot being retained on the webbing by a binding 50 which is advantageously a hinged plate or the like mounted on the mounting cross-piece 9 and which is intended to pivot around the transverse axis X, X', the aforementioned hinged plate including front retaining means 5*a*, and rear retaining means 5*b* for ensuring the retention of the boot of the user on the plate.

The webbing is at least partly realized by a flexible wall that we will call hereinafter the fabric 4 whose edge is intended to be mounted to the framework 2 in several places using mounting means. The aforementioned flexible wall for example is implemented in textile or of leather or other such as for example out of plastic material, such as out of extruded or injected plastic.

The framework 2 is advantageously made of a peripheral metal tube, for example out of aluminum or the like, such as steel or plastic or composite material. Of course one would not leave the invention if the peripheral framework were not unitary or closed on itself. It follows also that the element which makes up the framework could have another cross-section than that of a cylindrical tube.

According to one embodiment of the snowshoe 1 according to the invention this one advantageously has a vertical longitudinal plane of general symmetry P, but it could of course be different.

The peripheral tubular framework 2 has an elongated form, and comprises two side tube portions 2*a*, 2'*a* connected at the front AV by a front tube portion 2*b* extending from the side tubes and advantageously forming a raised spatula 5, while the side tubes 2*a*, 2'*a* are connected at the rear AR by a rear tube portion 2*c*.

The fabric 4 defining the webbing which has overall the general form of the interior of the framework 2 includes in the front a forward central hole 6 in order to allow the passage of the front of the boot at the time of its pivoting around the axis X, X', and the passage of the transverse mounting cross-piece 9.

In addition the fabric 4 is mounted to the tubular framework at least 2 in certain places, by portions made of covering fabric 40*a* . . . defining mounting feet. Thus, the fabric includes a central support zone which is extended towards the outside by several mounting feet. In other words, the mounting feet 40*a* . . . indicating the example of the mounting feet are made of bands of fabric extending from the fabric itself towards outside. These mounting feet 40*a*, 40*b*, 40*c*, 40*a*, 40'*b*, 40'*b*, 40*d*, 40*e* are intended to surround the tube of the framework 2 around the top and outside, to be mounted there thanks to a rivet 7 or the like.

Let us specify that the fabric 4 includes four rear side legs 40*a*, 40*b*, 40'*a*, 40'*b*, two front legs 40*c*, 40'*c*, a front end leg 40*e*, and a rear end leg 40*d*.

The rear side legs 40*a*, 40*b*, 40'*a*, 40'*b*, are those located laterally, behind the pivot axis X, X', while the front side legs 40*c*, 40'*c* are disposed at the level of the spatula 5, the end leg 40*e* on the front end of the spatula, while the rear leg 40*d* is at the rear end of the framework.

According to the invention, the snowshoe is such that it includes a protection means, to protect the fabric on the level from the places where it is mounted to the tubular framework, and this at the places likely to undergo abrasions such wear on the lower face which is caused when walking as well as a wear on the upper part and on the external portion of the fabric surrounding the tube which is caused by the various impacts and in particular by the impacts by the snowshoe carried by the other foot.

Thus the fabric 4 of the snowshoe according to the invention is protected by supplemental protection parts 8 disposed at least at level of the rear side mounting feet 40*a*, 40*b*, 40'*a*, 40'*b*.

The protection means are made up of supplemental protection parts 8 which are made for example out of injected plastic, and for example out of polyurethane, or the like. The supplemental protection parts 8 are intended to cover the mounting feet 40, in order to protect them, as announced previously.

The transverse mounting cross-piece 9 to which is mounted the pivoting plate is retained on the framework, in a mobile fashion, pivotally around the transverse axis X, X', and includes stop means limiting its forward pivoting.

According to the invention, the transverse mounting cross-piece 9 is mounted to the framework 2 via two couplings 7*a*, 7*b* of two retaining rings, respectively 7'*a*, 7"*a* and 7'*b*, 7"*b*. Namely a first end ring 7'*a*, 7'*b* and a second framework retaining ring 7"*a*, 7"*b*. Each end ring 7'*a* and 7'*b* is mounted to the end of the cross-piece 9 while each framework retaining ring 7"*a* and 7"*b* is mounted to the framework and more particularly to the tube of the framework for example by a mounting strap 10*a*, 10*b*. Thus the cross-piece 9 is retained to the framework by a left ring coupling 7*a*, and a right ring coupling 7*b*.

Let us specify that each end ring 7'*a* and 7'*b* passes through the hole defined in the corresponding framework retaining ring 7"*a* and 7"*b* and conversely, each framework retaining ring 7"*a* and 7"*b* passes in the hole defined in the corresponding end ring 7'*a* and 7'*b*.

Each ring includes a rectilinear connecting branch 70 and a curved mounting branch 71. The rectilinear connecting branch is that which is mounted in the mounting strap 10*a*, 10*b* for the retaining ring 7"*a* and 7"*b*, and with the cross-piece 9 for the end ring 7'*a* and 7'*b*, respectively.

Let us add that the branches of each ring are not in the same plane. Thus the curved branch 71 viewed from the end describes a kind of "Z" for the rings of the right coupling 7*b* and forms an "S" for the rings of the left coupling 7*a*.

Figure 4:
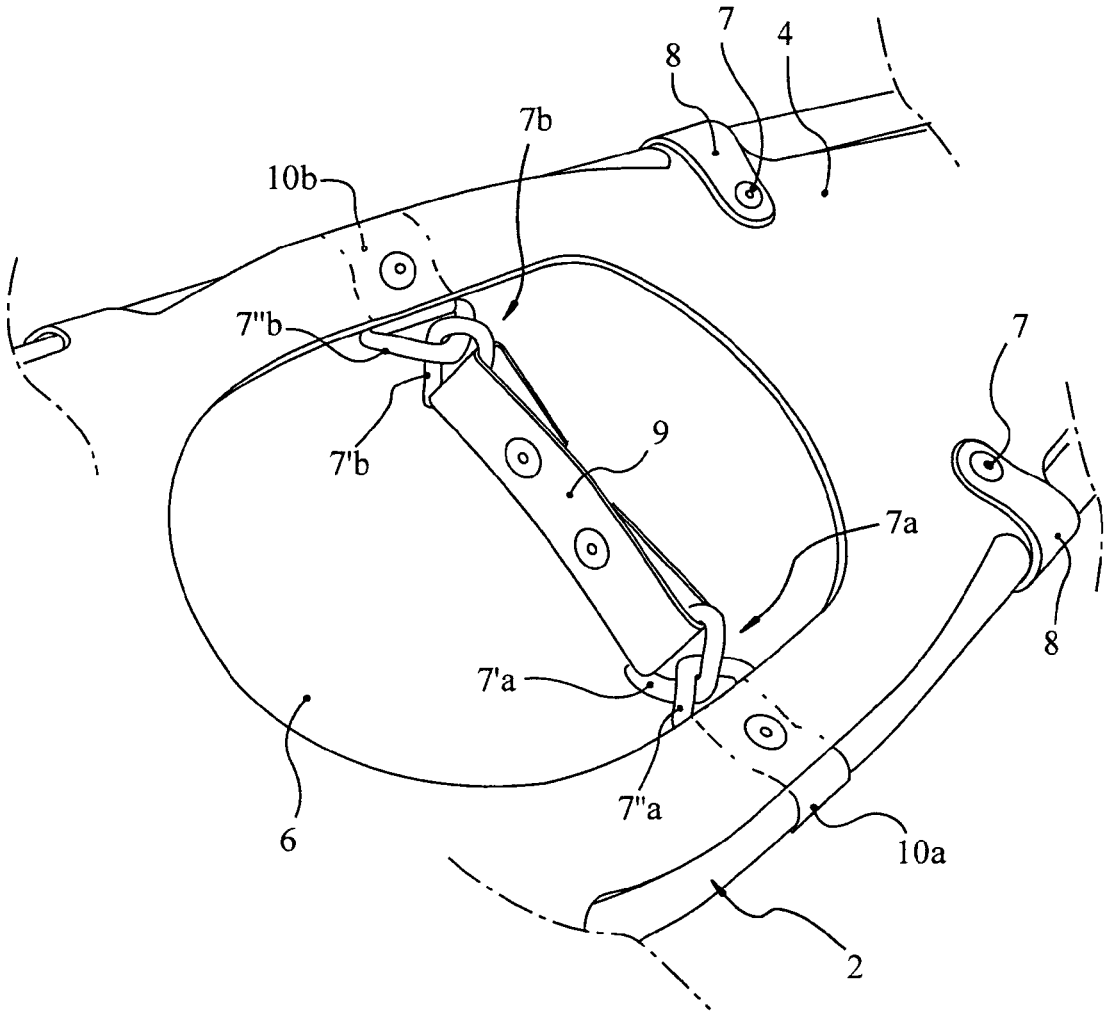
Figure 5A:
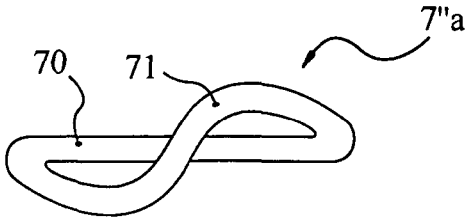
FIG. 5*a* is a side view viewed from the direction F1 of the retaining ring of the left coupling.
Figure 6A:
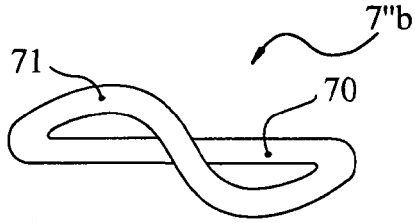
FIG. 6*a* is a side view viewed from the direction F1 of the retaining ring of the right coupling.
Figure 5:
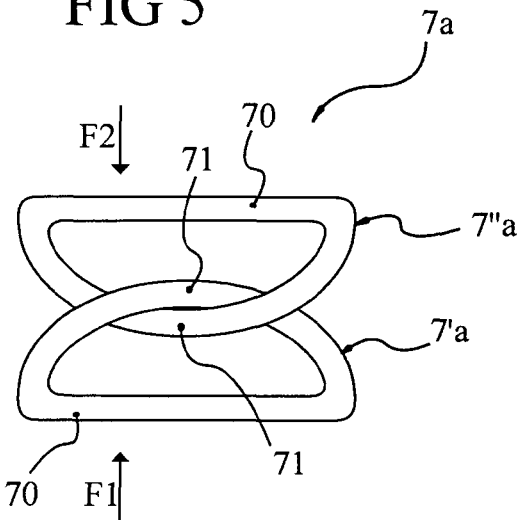
Figure 6:
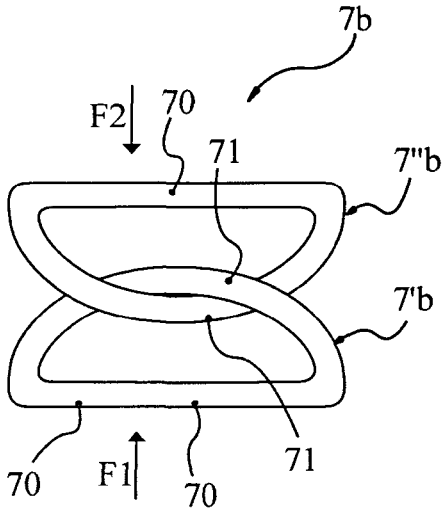
Figure 5B:
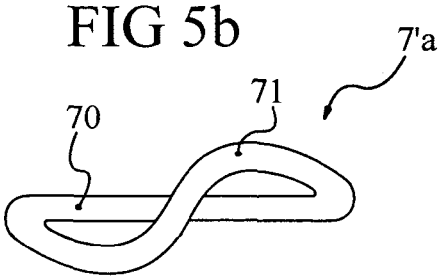
FIG. 5*b* is a side view viewed from the direction F2 of the end ring of the left coupling.
Figure 6B:
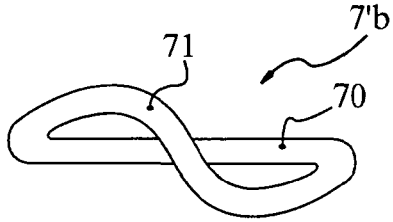
FIG. 6*b* is a side view viewed from the direction F2 of the end ring of the right coupling.
Figure 7:
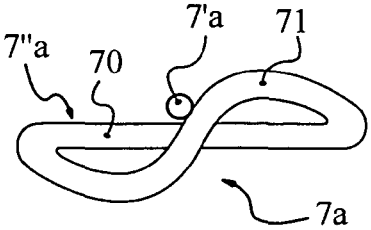
Figure 8:
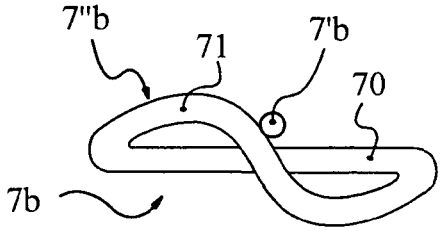

Thus, in the initial position such as illustrated on FIGS. 1, 2, 3, 5 and 6, the curved branches of each coupling are in rearward reciprocal abutment, namely that the curved branch of the framework retaining ring defines a rear stop for the curved branch of the end ring. When lifting the heel of the boot there is free forward pivoting of the cross-piece around the transverse axis X, X' until the curved branch of the framework retaining ring defines a front stop for the curved branch of the end ring such as appears on FIGS. 4, 7 and 8.

The peripheral framework 2, in the preferred embodiment, is of only one piece and is made of a continuously formed tube, but one would not leave the framework of the invention, if it were realized in several pieces or included not only one or two portions.

Of course, the invention is not limited to the modes of realization described and represented by way of examples, but it includes also all the technical equivalents like their combinations.

Thus, the rings could for example be not closed loops without leaving the framework of the invention.

It follows also that the end rings 7'*a*, 7'*b* could be not mounted on a transverse strap, but could form an integral part of the binding.

The invention, although described according to an embodiment with a framework and a fabric, can of course find application on any other type of snowshoe, and in particular one whose webbing is out of plastic.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A snowshoe comprising:

a binding for retaining a boot;

a cross-piece whose ends are mounted laterally to the snowshoe itself, said ends being mounted via two couplings of two rings, namely a left coupling and a right coupling, each ring including a rectilinear branch and a curved branch, the curved mounting branch viewed from the end forming a "Z" for the ring of the right coupling and forming an "S" for the ring of the left coupling, so that in an initial position, the curved branches of each coupling are in rear reciprocal abutment, namely that the curved branch of the framework retaining ring defines a rear stop for the curved branch of the cross-piece end ring, so that at the time of lifting a heel of the boot attached to the cross-piece, the cross-piece and the boot pivot freely around a transverse axis until the curved branch of the framework retaining ring defines a forward stop for the curved branch of the cross-piece end ring.

2. The snowshoe according to claim 1, wherein each coupling includes a retaining ring connected to the snowshoe coupled to a corresponding one of the end rings mounted to the ends of the crosspiece.

3. The snowshoe according to claim 2, wherein each cross-piece end ring passes through a hole defined by the corresponding snowshoe retaining ring and conversely, each snowshoe retaining ring passes through a hole defined by the corresponding cross-piece end ring.

4. The snowshoe according to claim 3, wherein each ring includes a rectilinear mounting branch and a curved mounting branch, the rectilinear mounting branch being that which is attached to the snowshoe for the snowshoe retaining ring, and to the cross-piece for the cross-piece end ring.

5. The snowshoe according to claim 4, wherein the branches of each ring are not in the same plane.

6. The snowshoe according to claim 1, further including a framework.

7. The snowshoe according to claim 6, wherein the snowshoe retaining rings are connected to the framework.

8. The snowshoe according to claim 7, wherein the snowshoe retaining rings are connected to the framework by mounting straps.

9. The snowshoe according to claim 6, further including:

webbing which includes a flexible wall maintained in tension inside the framework.

10. A snowshoe comprising:

a frame;

a pair of first D-rings connected to the frame, the first D-rings each including a curved portion, one of the D-rings having a Z-shape when viewed from its edge and the other having a S-shape;

a pair of second D-rings connected with a cross-piece, each of the first D-rings being inter-engaged with one of the second D-rings, the second D-rings each including a curved portion, one of the D-rings having an S-shape when received from its edge and the other having a Z-shape;

the S-shaped first D-ring and Z-shaped second D-ring being inter engaged and the Z-shaped first D-ring and the S-shaped second D-ring being inter-engaged; and a binding for a boot affixed with the cross-piece.

11. The snowshoe according to claim 10, wherein the first D-rings are mounted to the frame such that they are disposed in a substantially horizontal plane; and the second D-rings are mounted to the cross-piece such that they are in a substantially horizontal plane when the boot is horizontal, the second D-rings rotating in the first D-rings when the boot is tipped forward.

12. The snowshoe according to claim 10, wherein the frame extends peripherally around the snowshoe and further including:

fabric webbing held taught within the frame; and fabric straps mounting the first D-rings to the frame.

* * * * *